US009475676B2

(12) United States Patent
Ischganeit et al.

(10) Patent No.: US 9,475,676 B2
(45) Date of Patent: Oct. 25, 2016

(54) ESCALATOR OR MOVING WALKWAY HAVING A SECURITY DEVICE

(71) Applicant: THYSSENKRUPP FAHRTREPPEN GMBH, Hamburg (DE)

(72) Inventors: Ronny Ischganeit, Hamburg (DE); Christopher Busemann, Hamburg (DE); Thaddäus Wozniak, Hamburg (DE)

(73) Assignee: THYSSENKRUPP FAHRTREPPEN GMBH, Hamburg (DE)

( * ) Notice: Subject to any disclaimer, the term of this patent is extended or adjusted under 35 U.S.C. 154(b) by 0 days.

(21) Appl. No.: 14/417,108

(22) PCT Filed: Jul. 24, 2013

(86) PCT No.: PCT/DE2013/200075

§ 371 (c)(1),
(2) Date: Jan. 23, 2015

(87) PCT Pub. No.: WO2014/015870

PCT Pub. Date: Jan. 30, 2014

(65) Prior Publication Data

US 2015/0203330 A1 Jul. 23, 2015

(30) Foreign Application Priority Data

Jul. 24, 2012 (DE) ..... 10 2012 106 726
Sep. 21, 2012 (DE) ..... 10 2012 108 955

(51) Int. Cl.
*B66B 29/06* (2006.01)

(52) U.S. Cl.
CPC ..... *B66B 29/06* (2013.01)

(58) Field of Classification Search
CPC ..... B66B 29/06
See application file for complete search history.

(56) References Cited

U.S. PATENT DOCUMENTS 4,088,219 A * 5/1978 Binns ..... B66B 29/06 198/323
4,476,971 A * 10/1984 Schoneweiss ..... B66B 29/06 198/323

(Continued)

FOREIGN PATENT DOCUMENTS

CH 374169 A 12/1963
DE 680845 C 9/1939

(Continued)

OTHER PUBLICATIONS

German language International Search Report for International patent application No. PCT/DE2013/200075; mailing date Jan. 23, 2014.

(Continued)

*Primary Examiner* — Thomas Randazzo
(74) *Attorney, Agent, or Firm* — thyssenkrupp North America, Inc.

(57) ABSTRACT

In an escalator or moving walkway one comb plate, which mounts comb segments on which teeth which mesh with grooves in escalator steps or moving walkway panels are configured, is in each case provided at the entry and exit. On the comb segments, a safety installation having a predetermined size extends transversely to the running direction of the escalator or the moving walkway. The safety installation is mounted at the transition between the comb plate and the comb segments, and movements of the comb plate and/or of the comb segments are detectable via the safety installation.

20 Claims, 4 Drawing Sheets

(56) References Cited

U.S. PATENT DOCUMENTS

| | | | | | |
|---|---|---|---|---|---|
| 4,800,998 | A * | 1/1989 | Myrick | B66B 29/06 | 198/323 |
| 5,255,771 | A * | 10/1993 | Nurnberg | B66B 29/06 | 198/323 |
| 5,307,918 | A * | 5/1994 | Rivera | B66B 29/02 | 198/323 |
| 5,398,800 | A * | 3/1995 | Hofling | B66B 29/06 | 198/323 |
| 5,718,319 | A * | 2/1998 | Gih | B66B 29/06 | 198/323 |
| 6,241,070 | B1 * | 6/2001 | Loder | B66B 29/06 | 198/323 |
| 6,644,457 | B2 * | 11/2003 | Lauch | B66B 29/06 | 198/322 |
| 6,966,419 | B2 * | 11/2005 | Tada | B66B 29/06 | 198/323 |
| 6,976,571 | B2 * | 12/2005 | Schops | B66B 29/06 | 198/323 |
| 7,334,672 | B2 * | 2/2008 | Sheehan | B66B 29/06 | 198/323 |
| 8,264,538 | B2 * | 9/2012 | Horbruegger | B66B 29/06 | 348/143 |

FOREIGN PATENT DOCUMENTS

| | | | |
|---|---|---|---|
| DE | 2824452 | A1 | 12/1979 |
| DE | 29907184 | U1 | 8/1999 |
| EP | 1157958 | A1 | 11/2001 |
| EP | 2471738 | A1 | 7/2012 |
| JP | H06144766 | A | 5/1994 |
| JP | H072373 | U | 1/1995 |
| JP | H092771 | A | 1/1997 |

OTHER PUBLICATIONS

English translation of the International Search Report for International patent application No. PCT/DE2013/200075; mailing date Jan. 23, 2014.
English translation of abstract of JP H06144766 (A).
English translation of abstract of CH 374169 (A).
English translation of abstract of JP H092771.
English translation of abstract of EP 2471738 (A1).
English translation of abstract of DE 29907184 (U1).
English translation of abstract of EP 1157958 (A1).

* cited by examiner

ESCALATOR OR MOVING WALKWAY HAVING A SECURITY DEVICE

CROSS REFERENCE TO RELATED APPLICATIONS

This application is a U.S. National Stage Entry of International Patent Application Serial Number PCT/DE2013/200075, filed Jul. 24, 2013, which claims priority to German patent application nos. DE 102012106726.0 filed Jul. 24, 2012, and DE 102012108955.8 filed Sep. 21, 2012.

FIELD

The invention relates to an escalator or a moving walkway, and to a method for operating the same.

BACKGROUND

It has been known for a long time that escalators and moving walkways must be stopped when defects arise in the region of the so-called comb plate at the entry or exit. Comb plates typically carry a plurality of comb segments which are distributed across the width of the escalator or of the moving walkway and which have teeth or forks which mesh with channels or grooves in the escalator steps or moving walkway panels.

Manufacturers of escalators and moving walkways of this type do pay attention to the lateral free play of the forks in relation to the webs of the escalator steps or moving walkway panels being sufficiently dimensioned such that there is in the normal case no contact—and thus typically no tooth breakage. However, when the escalator step, or else the respective comb segment, is subjected to excessive lateral offset on account of an external influence, the respective web impacts a tooth, which inevitably leads to tooth breakage.

Tooth breakage implies a risk for the passengers of the escalator or of the moving walkway, such that a stoppage of the escalator or of the moving walkway has to be automatically initiated.

On account of the tooth breakage a significant force is exerted on the respective tooth segment, leading to the dislocation of the latter. The dislocation may take place vertically or in a substantially horizontal manner or else obliquely, depending on the angle of impact of the tooth on the web, the dislocation typically being reversible.

In order for tooth breakage to be identified and the required measures to be initiated, measures in the form of providing safety installations which are to detect the movement of the comb segment and/or of the comb plate and trigger an alarm signal have been known for a long time.

An early example thereof is DE 680 845, according to which a belt-shaped safety member is said to extend transversely across the width of the escalator. This safety member is guided in a groove or bore which is just above the surface of the escalator step and which extends through the comb segments or, more precisely, through the actual teeth, in a transverse manner across the width of the escalator. A light barrier or a lacerable belt may also be employed as a safety member, and raising of the escalator step beyond a permissible dimension would also lead to the safety installation being triggered.

Furthermore, DE 299 07 184 A1 discloses an escalator and a moving walkway wherein the comb segments there have on the teeth a line which is said to be interrupted in the case of tooth breakage. Whilst this solution is fundamentally very safe, it does require, however, for the line to be renovated in the case of the breakage of a tooth and the replacement of the respective comb segment which is thus required. In contrast thereto, the method disclosed in DE 299 07 184 A1 for example has the disadvantage that the line to be interrupted is accessible from the outside and thus may also be interrupted by events which do not make safety-related disabling of the steps necessary.

Indeed, a glass-fibre conductor may also be used as a line; but said glass-fibre conductor would also have to be renovated in the potential case of a breakdown on account of tooth breakage, this likewise leading to additional costs.

SUMMARY

In contrast thereto, the invention is based on the object of achieving an escalator or a moving walkway which is as safe as known solutions but enables the respective damage to be identified in an improved manner and nevertheless does not cause additional costs in the event of damage.

The invention is furthermore based on the object of providing a method for the safe operation of an escalator or of a moving walkway, which has good operational reliability.

BRIEF DESCRIPTION OF THE DRAWINGS

The present disclosure is described in detail below with reference to the attached drawing figures, wherein.

DETAILED DESCRIPTION

Figure 1:
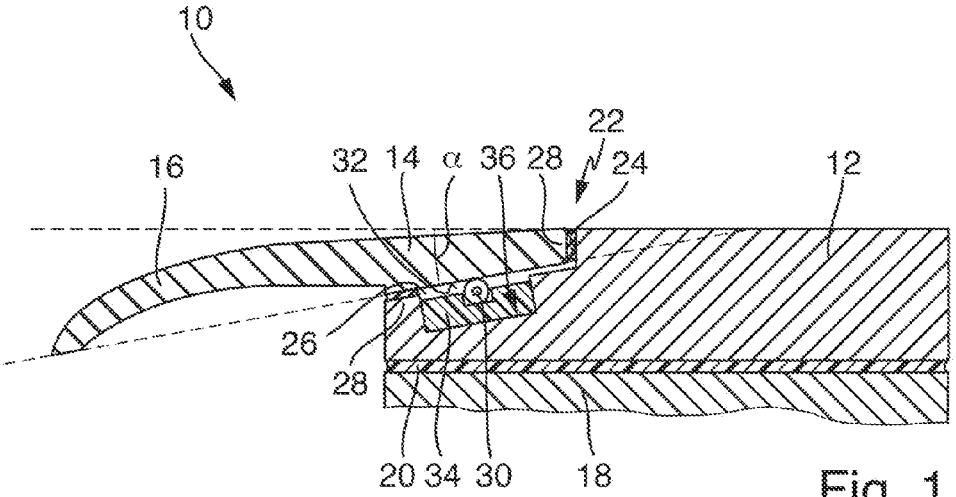
FIG. 1 shows a schematic section through part of an escalator according to the invention or a moving walkway according to the invention, illustrating the safety installation, the comb plate, and the comb segment, in a first embodiment.

It is particularly favourable according to the invention that a safety installation is mounted at the transition between the comb plate and the comb segments, and to that extent is surrounded in a protected manner by both. To this extent, said safety installation is protected against breakdown, damage, and negative influences on account of contamination—very much in contrast to the previously known designs.

In contrast to the previously known designs, an indirect solution is provided according to the invention, namely in that the safety installation detects the movement of the comb plate and of the comb segments. The movement of the comb plate, and also the movement of comb segments, and also the movement of both, but also the relative movement between the comb plate and the comb segments is to be subsumed thereunder.

In the case of relative movements which are detected in this manner and which exceed a predetermined measure, the required reaction is manually or preferably automatically induced; for example, switching off the escalator or the moving walkway is prompted. Such switching off is required, for example, when an object, such as a person who has fallen, comes to lie on the comb plate and continuous loading of the comb plate thus arises. On account of the load on the comb plate, the safety installation which is guided in an elastic manner between the comb plate and the comb segments is deformed, on account of which the properties of said safety installation are changed.

Displacements of the comb plates in any arbitrary direction, i.e. horizontal and vertical and likewise oblique displacements which result from the superimposition of horizontal and vertical movements, can be identified, specifically in the case of the implementation of the oblique face which is favourable according to the invention and which is described further below, and objects which are jammed in the combs or steps or panels, respectively, generate characteristic signal shapes which can be identified by means of an evaluation unit. In the case of breakage of a tooth of a comb segment a characteristic signal which can be identified according to the invention is likewise produced.

The safety installation according to the invention may be configured as a capacitive or inductive proximity sensor, as a resistance sensor, as an optical sensor or else as a flow sensor, as will be explained in more detail in the following. It goes without saying that further suitable sensors may also be used, as long as they are suitable in terms of construction for spanning the entire width of the comb plate or the entirety of the comb segments.

By way of movement of the comb plate and/or of the comb segments at least a slight deformation of the safety installation takes place according to the invention. This deformation of the safety installation according to the invention may be a locally limited deformation, i.e. only a portion of the safety installation is deformed. The deformation may be bending, in particular localized bending of the safety installation, for example. The deformation leads to a change of properties of the safety installation. According to the invention, these properties may comprise the capacity, the inductivity, the resistance, the optical conductivity, or the flow properties. The change in the specific behaviour of the safety installation is detected according to the invention, and the output signal of the safety installation is transmitted to an evaluation unit.

The fact that an escalator or a moving walkway in operation has a revolving belt of steps or panels can be particularly favourably exploited according to the invention for the evaluation; tooth breakage typically is preceded by the teeth in the respective comb segment being located outside of the predetermined position. In the case of slight lateral or vertical contact, no tooth breakage takes place yet, but the respective contact leads to minimal dislocation of the comb segment, which is detectable according to the invention. The solution according to the invention is thus significantly more sensitive than the solutions from the prior art which have been described at the outset.

However, it is also possible for a step or panel on its upper side to have slight damage which is however not dangerous and has not yet led to tooth breakage, for example. The evaluation unit can then determine that deflection of the safety installation takes place once per revolution of the step belt or panel belt, and on account of advising the maintenance centre it is possible for maintenance of the escalator to be performed before tooth breakage has occurred, that is to say before the escalator has to be permanently disabled.

According to the invention, mounting of the safety installation can be preferably accomplished in that the latter is mounted so as to bear on the comb segments, specifically on the lower side of the comb segments, and by way of an elastic element or an elastic compound which is provided in or on the comb plate is pressed against the comb segments. A rubber element may be used as an elastic element, for example. An elastic compound may be formed by an integrally cast elastomer, the hardness of which is adapted to the requirements, for example. The safety installation when cast is preferably inlayed at the desired position, such that the former indeed protrudes somewhat from the elastic compound but is mounted therein and is surrounded in part thereby. Alternatively, a mounting groove for the safety installation may be conjointly cast during casting, in which mounting groove the safety installation is then inlayed without play.

Alternatively, it is also possible for a kinematic reversal to be provided to the extent that the elastic compound is received in the comb segments and the safety installation is pressed against the upper side of the comb plate. In any case, both design embodiments enable the safety installation to be received in a protected manner but to nevertheless to be sensitive in response to relative movements between the comb plate and the comb segments.

In a particularly favourable design embodiment a clearance may be selectively provided in the comb plate or in the comb segments, or else in both the comb plate and in the comb segments, in which clearance the safety installation according to the invention is guided. This clearance offers mechanical protection for the mounting of the safety installation. Since the comb plate and the comb segments are usually composed of metal, the clearance which is incorporated therein can furthermore also be used as an electric shield of the safety installation for some of the sensor types which are provided according to the invention, for example, the capacitive and inductive proximity sensors.

The safety installation may also bear on the comb segments which is favourable according to the invention, and hereby in particular on the oblique lower sides thereof, wherein the comb segments by way of the safety installation are mounted so as to be elastically pretensioned in relation to the comb plate or else to the balustrade base of the escalator or of the moving walkway. Moreover, it goes without saying that the comb segments may be mounted at the comb platte so as to be pretensioned against the effect of the elastic compound in which the safety installation according to the invention may be embedded.

However, it also goes without saying that in advantageous refinements of the invention also the entire movement of the comb plate having the comb segments in relation to the frame of the escalator or of the moving walkway is readily detectable. To this end, the safety installation is likewise mounted in the region of the balustrades, and in the event of a relative movement between the comb plate and the balustrade elastic bending of the safety installation likewise takes place, such that to that extent a signal which is able to be evaluated is generated.

In the case of this solution in the event of the mentioned deflection deformation of the safety installation takes place at the initial side and at the end side of the safety installation. Static detection of the output signal of the safety installation does not permit an evaluation as to where the deflection of the safety installation takes place, since the statically detected signal value does not vary.

According to the invention it is also favourable for the safety installation to be able to be accommodated in a manner safe from contamination and requiring low maintenance. This also applies to the transition between the comb plate and the comb segments which at their surfaces are configured so as to be flush with one another, such that no tripping ledge results.

In order to avoid contamination of the movement gap between the comb segments and the comb plates it is readily possible for said movement gap to be filled at least on the upper side of the comb plate and of the comb segment with an elastic compound; if and when required, the movement gap which, in the cross section, is substantially L-shaped, may be completely filled with elastic compound.

According to the invention it is also possible for the type of evaluation to be expanded. For example, when a person who has fallen or another object comes to lie on the comb plate, the escalator or the moving walkway must be switched off, and this can be likewise identified according to the invention, as can jammed objects which lead to deformation of the safety installation.

It is favourable according to the invention that not only vertical but also horizontal displacements of the comb plates can be identified. On account of an oblique positioning of the transition face between the comb plate and the comb segment, a change in loading of the elastically mounted safety installation also takes place in the event of a horizontal dislocation, which leads to the deformation thereof, such that such a horizontal dislocation is also able to be evaluated.

It is favourable according to the invention that the type of breakdown triggers a characteristic signal in the safety installation. For example, breakage of a tooth causes a characteristic impulse having a short and damped post-pulse oscillation.

By means of comparing the detected signal to a stored reference signal the evaluation unit may be able to identify which type of breakdown is present.

In this context it is favourable for signals which arise in the normal operation of an escalator or of a moving walkway to be identified and to be filtered out as being irrelevant. For example, when passengers step onto comb segments, compression of the elastic compound for the mounting of the safety installation likewise takes place, together with corresponding signalling to the evaluation unit. Said signalling is typical in respect of its signal shape, that is to say the rise time, duration of the load, type of the load, and the fading time, such that said signal is readily identifiable. The same applies to various loading situations, and also a heavyweight man standing on the comb segment leaves a load signal which is different from that of a tooth breakage, for example.

The solution according to the invention is also independent of weather influences, as on account of the protected mounting of the safety installation which is cast into an elastic compound, for example, imperviousness with respect to moisture but also frost is a given.

According to the invention it is also favourable for the evaluation unit to automatically perform a calibration when the escalator or the moving walkway starts up, in order to automatically compensate for a drift of the properties of the safety installation which may be possible over the years and to at all times retain the desired sensitivity for various loading situations.

Further advantages, details, and features are derived from the following description of exemplary embodiments of the present disclosure by reference to the attached drawings.

The escalator 10 which is schematically illustrated in FIG. 1 has a step belt which is not illustrated. On the entry side and the exit side of the escalator the latter is equipped with a comb plate 12. A plurality of comb segments are mounted on the comb plate 12, wherein one comb segment 14 is illustrated in section in FIG. 1. The comb segments each have teeth 16 which mesh with channels (not illustrated) which are provided in the surface of the escalator 10.

The escalator has a frame 18 which is schematically illustrated in FIG. 1 and carries the balustrade and the rails on which the escalator steps run, for example. The comb plates 12 are somewhat elastically mounted on the frame 18, which is intended to be symbolized through the spring element 20 which is illustrated in FIG. 1.

In practice, the revolving belt of the escalator steps extends into the region which in FIG. 1 is filled by the comb plate 12 and the frame 18; in fact, the comb plate 12 extends like a type of bridge across the step belt and in the region of the balustrade is on both sides supported on the frame 18, this here in FIG. 1 being illustrated in the same plane for reasons of a simplified illustration.

The comb segments 14 are connected to the comb plate 12 by way of screw bolts which nevertheless permit a certain and slight relative movement between the comb segments 14 and the comb plate 12. Accordingly, a movement gap 22 which has a vertical leg having a vertical face 24 and a leg 26, which runs so as to be slightly oblique, having an oblique face 32 is provided between the comb segments 14 and the comb plate 12. The two legs 24 and 26 at the end side are closed off by an elastic sealing compound 28, such that the movement gap 22 is not able to be clogged by contaminants. On account thereof, moreover a certain elasticity of the mounting is predetermined.

Furthermore, according to the invention a safety installation 30 is provided in the region of the oblique leg 26. The safety installation 30 [is in this embodiment configured as a light conductor], which is only schematically illustrated in FIG. 1 and bears on the oblique face 32 which is configured on the lower side of the comb segments 14. The safety installation 30 is mounted in an elastic element 34 which already in its normal state, that is to say without the relative loading between the comb segment 14 and the comb plate 12, presses the safety installation 30 against this oblique face 32. In this normal state the safety installation 30 is situated in a rest position, i.e. in a position in which said safety installation 30 is not deformed and deflected on account of relative movements between the comb plate 12 and the comb segment 14.

The oblique face 32 runs in an oblique manner at an angle deviating by less than 45° from the horizontal down towards the teeth 16 of the comb segments 14, to this extent approximately parallel in relation to the latter, and the safety installation 30 is configured in the course of this oblique face 32 on the lower side of the comb segments 14, in the illustrated exemplary embodiment in the centre of the oblique face 32.

The elastic compound 34 is mounted in a clearance 36 having a width-to-depth ratio of 3 to 1, for example, which is suitably configured for this purpose. The safety installation 30 clearly protrudes in relation to the elastic compound 34 or in relation to the elastic element 35 (cf. FIG. 3), respectively. To this end a mounting groove is left behind in the elastic element 35, which mounting groove in its width is preferably somewhat smaller than the diameter of the safety installation 30, and in its depth amounts to about 60% of the diameter of the safety installation 30.

It goes without saying that in place of a special mounting groove, the safety installation 30 may also be cast or moulded in a protruding manner into the elastic compound 34 or the elastic element 35.

Between the comb plate 12 and the comb segment 14, the safety installation 30 is surrounded thereby and received in a protected manner and also in the event of tooth breakage of one tooth 16 or a plurality of teeth 16 of a comb segment 14 remains unscathed. A protective encapsulation of the safety installation 30 is provided, which protective encapsulation is achieved in that the comb segments 14 and the comb plate 12 surround or enclose the safety installation 30, respectively.

On account of the safety installation being received in a protected manner, a low failure rate of the safety installation 30, which is encapsulated in a manner safe from contamination and inaccessible from the outside, results, amongst other things.

The safety installation 30 extends in a transverse manner across the entire width of the escalator 10 and on the end side is mounted on the frame 18. Since the comb plate 12, by way of the spring element 20, is elastically mounted on the frame 18, the safety installation 30 thus not only responds to relative movements between the comb segment 14 and the comb plate 12, but also to movements of the unit formed by the comb segments 14 and the comb plate 12 in relation to the frame 18.

In the unloaded state, in particular the straight aligned state, the safety installation 30 has certain specific properties. In the case of a capacitive proximity sensor according to the invention, said safety installation 30 has a specific rest capacity, for example, in the case of a flow sensor according to the invention it has a known basic flow of the suitable medium, for example air, which flows through the safety installation.

Now, if localized deformation or compressive loading of the safety installation 30 takes place, for example because the comb segment 14 is moved in relation to the comb plate 12 on account of tooth breakage or of another undesired event, the properties of the safety installation 30 change, leading to signals which are able to be evaluated, for example by way of a rise of the capacity of the capacitive proximity sensor according to the invention, because the electrodes converge on one another, or by way of a reduction of the volume flow in the case of the flow sensor according to the invention.

Figure 2:
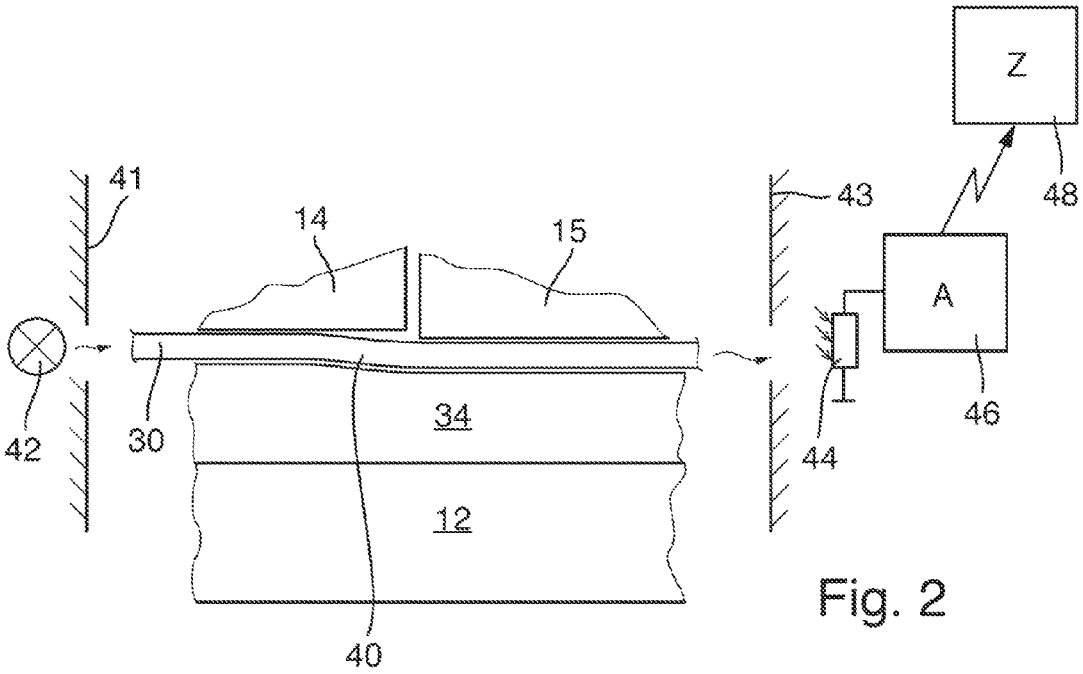
FIG. 2 shows a schematic view through a safety installation according to the invention, in an illustration which is transverse to the illustration of FIG. 1, wherein one comb segment is illustrated in the depressed position.

For the case of the optical sensor according to the invention, this is schematically illustrated in FIG. 2, which case in the following is to be used in an exemplary manner for explaining the principle on which the safety installation according to the invention is based.

In FIG. 2, a further comb segment 15 is illustrated besides the comb segment 14. We assume that the comb segment 15 is now somewhat depressed—due to a breakdown or due to normal loading, whatever the case may be. The elastic tube of the safety installation 30 is mounted in the elastic element 34, and by depressing the comb segment 15 a substantially S-shaped deformation 40 of the safety installation 30 takes place in the transition region below the comb segment 14, as is illustrated in FIG. 2. This is a reversible deformation. Once the loading which causes the deformation of the safety installation disappears, the safety installation reverts to its rest position and is ready for operation again. In this way it can be avoided that the safety installation has to be completely replaced in the case of a fault.

In the region of the two radii of curvature of the S-shaped deformation 40 the effective cross section of the elastic tube of the optical sensor arrangement is now reduced, specifically depending on how intensely the comb segment 15 has been dislocated in relation to the comb segment 14.

On account thereof, the light-passage properties of the safety installation 30 change. The safety installation 30 in the rest position preferably extends in a rectilinear manner, such that the light passage takes place with minimum loss and the output signal of the light sensor 44 is at maximum.

The safety installation 30 is configured as an elastic tube which responds to movements of the comb plate 12 and/or of the comb segments 14, wherein the safety installation 30 is deformable by movements of the comb plate 12 and/or of the comb segments 14 while changing its light-passage properties in the case of the optical sensor illustrated in FIG. 2.

For the present exemplary embodiment, a light source 42 is mounted laterally of the step belt or panel belt, that is to say in the region of the balustrade 41, and a light sensor 44 is mounted in the opposite balustrade 43. The balustrades 41 and 43 are mounted on the frame 18 (cf. FIG. 1).

During operation, light is fed into the safety installation 30 on one side by the light source 42, and the light sensor 44 detects the light exiting from the safety installation 30. The output signal of the light sensor 44 is transmitted to an evaluation unit 46. The evaluation unit 46 determines whether the received signal indicates a breakdown case which either requires signalling to a centre or, as is the case when one of the teeth 16 break, for example, also requires the escalator 10 to be switched off.

In FIG. 2, this is schematically illustrated by way of the maintenance centre 48 there. Signalling may be carried out in a wireless manner, or else via an internet connection, for example.

The mounting of the light source 42 and the light sensor 44 in a fixed manner on the balustrade also enables the relative movement between the balustrade, on the one hand, and the comb plate 12, on the other hand, to be detected, if and when required.

After evaluation and classification by the evaluation unit 46, all signals of the light sensor 44 which have been detected are preferably transmitted to the maintenance centre 48, such that the latter is at all times informed about the utilization of the escalator. Also during normal operation a signal is indeed triggered when the comb plate 12 and/or the comb segment 14 is stepped upon, which signal is detectable but is clearly different from a breakdown signal.

By way of the safety installation according to the invention safety-relevant breakdowns can be detected and evaluated in an automatic manner, for example, such that automated disabling for safety reasons is possible. Alternatively, disabling for safety reasons may take place manually, once the evaluation of the measured values has indicated a safety-relevant breakdown and an operator of a maintenance centre has been alerted to the present breakdown, for example.

Figure 3:
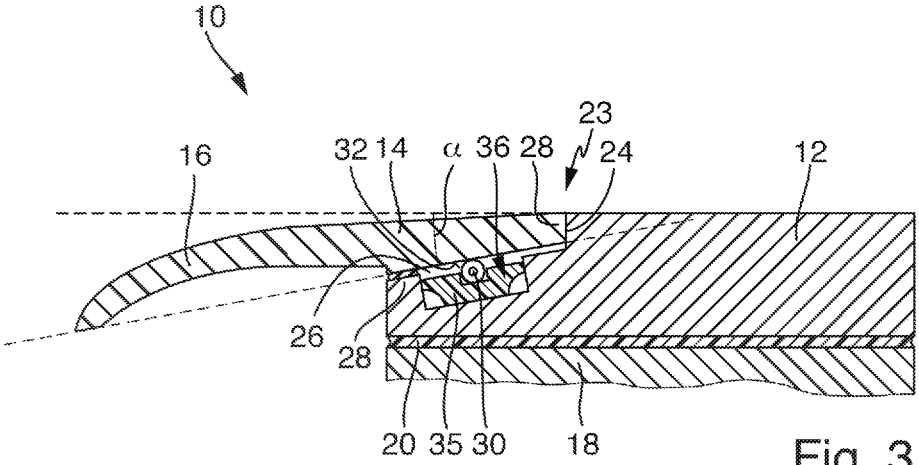
FIG. 3 shows a schematic section through part of an escalator according to the invention or of a moving walkway according to the invention, illustrating the safety installation, the comb plate, and the comb segment, in a second embodiment.

FIG. 3 shows a modified design embodiment in which a transition 23 is configured in a gap-free manner instead of the movement gap 22 of FIG. 1, such that the comb segments 14 and the comb plate 12 at their surfaces transition into one another in a gap-free manner.

In an exemplary embodiment which is not illustrated here and which is modified in contrast thereto, the gap-free transition is implemented by way of an elastic cover element which covers the transition 23 in the manner of a bridge, and is specifically sunken in the comb plate 12 and the comb segment 14 in such a manner that a flush surface is created.

Furthermore, in the case of the exemplary embodiment according to FIG. 3 an elastic element 35 is provided instead of the elastic compound 34. The former forms a moulded body which extends in the clearance 36. The moulded body 35 may extend in the groove either along the entire step width or panel width, respectively. Alternatively, said moulded body 35 may be subdivided into moulded segments. On account of the modular construction system, this allows simplification of stock-keeping in the case of various escalator widths.

Figure 4:
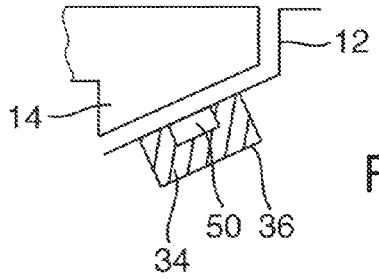
FIG. 4 shows a schematic section through part of an escalator according to the invention or of a moving walkway according to the invention, illustrating the safety installation in a first preferred embodiment.

FIG. 4 illustrates the preferred design embodiment of the safety installation according to the invention as a capacitive proximity sensor, in which a ribbon conductor 50 which serves as a first electrode is embedded in the elastic compound 34 in the clearance 36 in the comb plate 12 which is only schematically illustrated. The comb segment 14 which lies opposite the clearance in this preferred design embodiment represents the counter electrode.

It goes without saying that alternatively the ribbon conductor, or alternatively a round conductor or another suitable electrically conductive device may of course be received in the comb segment and the comb plate 12 may accordingly serve as a counter electrode. The first electrode also does not have to be cast or embedded into the elastic compound, respectively. In any case, however, an electrically isolated arrangement of the first electrode in relation to the counter electrode is required in order to enable the configuration of an electrical capacity.

In the event of the comb segment 14 converging on the first electrode 50, on account of the reduction of the plate distance the capacity of the capacitor formed by the first electrode and the counter electrode is increased, which can be detected in a suitable evaluation unit. On account thereof, the movement of the comb segments out of a rest position can thus be detected.

On account of the metallic construction of the comb plate and of the comb segments the possibility of using said comb plate and comb segments as electric shielding for the first electrode in relation to external interference influences furthermore results. By way of a suitable electrically insulating coating or covering, respectively, of the first electrode 50, of course care has to be taken that no short circuit can arise between the electrode 50 and the counter electrode.

Figure 5:
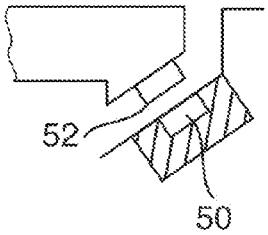
FIG. 5 shows a schematic section through part of an escalator according to the invention or of a moving walkway according to the invention, illustrating the safety installation in a further preferred embodiment.

In FIG. 5 the preferred embodiment of a capacitive proximity sensor is likewise illustrated, albeit this time having two electrodes, i.e. two conductors 50 and 52 which are disposed on the comb segments or the comb plate, respectively. Here the second conductor 52 is supported in an electrically non-conducting manner on the comb segment 14. This embodiment avoids disadvantages which can result from using the comb plates as counter electrodes, for example on account of contamination of said comb plates. Otherwise, the same applies as has been stated in conjunction with FIG. 4.

In order to minimize the risk of rupture of the second conductor 52 on the edges of the comb segments 14 when individual comb segments move in relation to the comb segments which are directly adjacent thereto, these edges can bevelled. Moreover, the use of a conductive polymer, for example, for configuring the second conductor 52 may likewise significantly reduce the risk of rupture.

Figure 6:
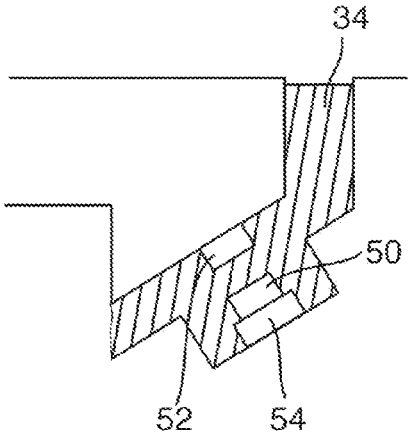
FIG. 6 shows a schematic section through part of an escalator according to the invention or of a moving walkway according to the invention, illustrating the safety installation in a further preferred embodiment.

FIG. 6 illustrates the capacitive proximity sensor having two conductors 50 and 52 according to FIG. 5, but here having a completely cast intermediate space between the comb plate and the comb segments. On account thereof, the two conductors 50 and 52 are entirely embedded and to this extent protected against the intrusion of moisture and dirt.

Moreover, the first conductor 50 is supported on a largely incompressible base 54, in the illustrated example a PVC strip, on the comb plate. On account thereof, an improvement of the sensitivity of the sensor in relation to the "floating mounting" according to FIG. 5 is achieved.

The filling of the intermediate space between the comb segments 14 and the comb plate 12 with the elastic compound 34 in the case of the embodiment according to FIG. 6 is dimensioned such that said filling in the case of an optionally required replacement of individual comb segments, for example following breakage of a tooth, has to be compressed. On account thereof, improved bearing of the elastic compound on the comb segments is ensured even in the case of high temperature variations.

Figure 7:
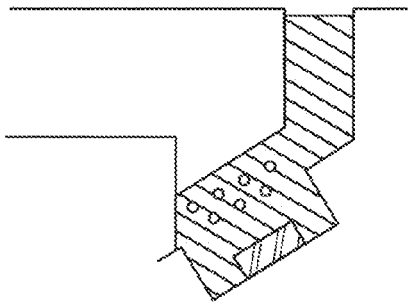
FIG. 7 shows a schematic section through part of an escalator according to the invention or of a moving walkway according to the invention, illustrating the safety installation in a further preferred embodiment.

FIG. 7 illustrates a further preferred embodiment of the safety installation according to the invention, in which an inductive proximity sensor is used. The intermediate space between the comb segments and the comb plate here also may be entirely cast again with the elastic compound 34, as is illustrated. The movements of the comb segments here cause a change in the energy of an oscillating circuit which is inter alia formed by the conductor loop (coil) which is cast into the elastic compound. By way of an increase in the number of conductor loops an increase in sensitivity can be achieved.

Figure 8:
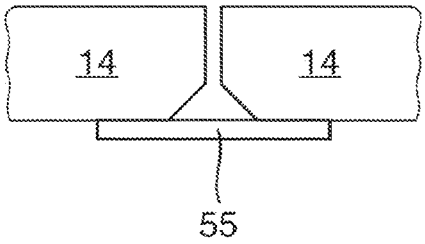
FIG. 8 shows a schematic section in an illustration which is transverse to the illustration according to FIG. 1, through part of an escalator according to the invention or of a moving walkway according to the invention, illustrating two comb segments and the safety installation, in a further preferred embodiment.

FIG. 8 illustrates a further preferred embodiment of the safety installation according to the invention, in which a resistance sensor, here a strain gauge, is used. Two adjacent comb segments 14, the lower opposite edges of which are bevelled in order to reduce the risk of damage (as has already been described for FIG. 5), are connected to a strain gauge. In the event of one comb plate moving in relation to the adjacent comb plate, the resistance value of the measuring tapes bridging the two segments is changed, this being detected by the connected evaluation unit. By way of the potential connection in series of the individual strain gauges which bridge the respective transitions between the individual comb segments an amplification of the signals which are able to be evaluated is achieved.

Figure 9:
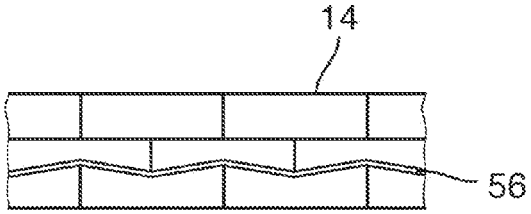
FIG. 9 shows a schematic section in an illustration which is transverse to the illustration according to FIG. 1, through part of an escalator according to the invention or of a moving walkway according to the invention, illustrating the safety installation and a few comb segments, in a further preferred embodiment.

FIG. 9 illustrates an alternative to the preferred embodiment illustrated in FIG. 8, wherein here a single strain gauge tape 56 which runs across the entire width of the escalator is used. Said strain gauge tape 56 is laid, preferably in a zigzag pattern, across protrusions which exist below the comb segments, wherein, of course, any other suitable arrangement in which a certain pretensioning of the tape 56 can be implemented may be applied. In the event of individual comb segments moving, a change in the resistance of the strain gauge tape 56 is caused at the respective transitions between moving and adjacent segments, wherein the individual changes in resistance add up.

Figure 10:
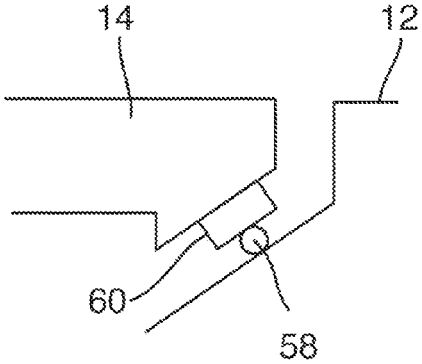
FIG. 10 shows a schematic section through part of an escalator according to the invention or of a moving walkway according to the invention, illustrating the safety installation in a further preferred embodiment.

FIG. 10 illustrates a modification of the embodiment according to FIG. 9, wherein a soft resistance cord (resistance rubber) 58 extends across the entire width of the escalator, below the comb segments 14. Each comb segment is provided with a block-shaped protrusion 60 which in the event of the comb segment 14 being lowered presses onto the resistance rubber 58 and therein causes a detectable change in resistance. It goes without saying that the protrusions 60 and the resistance cord 58 have to be dimensioned such that severing of the resistance cord 58 is precluded even in the case of overloading.

Figure 11:
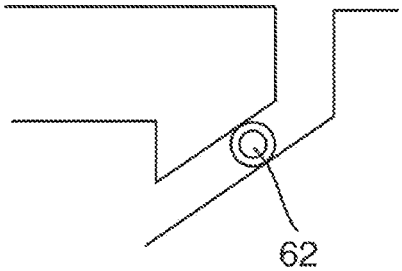
FIG. 11 shows a schematic section through part of an escalator according to the invention or of a moving walkway according to the invention, illustrating the safety installation in a further preferred embodiment.

FIG. 11 illustrates a further preferred embodiment of the safety installation according to the invention, wherein here an elastic tube 62 extends across the entire width of the comb plate 12, as has already been described further above for FIG. 2. While the arrangement which was described in an exemplary manner in conjunction with FIG. 2 related to an optical sensor which is to be described once more in more detail further below, a further preferred embodiment of the safety installation according to the invention uses a flow sensor. Here, the elastic tube 62 is passed through by a suitable medium, for example air, wherein in the rest position of the comb segments 14 a rest flow through the elastic tube 62 arises. Once on account of movement of at least one of the comb segments in relation to its directly adjacent segment a cross-sectional change of the tube 62 is caused, the flow volume which can be detected at the end of the tube also changes.

A similar situation prevails in the already mentioned optical embodiment, wherein here the intensity of the light radiation which is guided through the tube 62 is detected rather than a flow. A cross-sectional change in the tube here causes a reduction of the intensity of the light radiation at the light sensor 44. The light source here is disposed so as to be opposite to the light sensor, at the other end of the tube 62.

It goes without saying, however, that the light source 42 and the light sensor 44 may also both be disposed on the same side of the tube, if a light-reflecting element is disposed on the opposite end of the tube. This may enable simpler electrical cabling, since electrical terminals for the safety installation according to the invention then only have to be present on one side of the escalator.

Moreover, it is, of course, also possible to use a light conductor instead of the tube 62, which light conductor has a fibre core and a fibre sleeve, and in which in the unloaded state a total reflection of the light arises at the transition between the fibre core and the fibre sleeve. In the event of the light conductor being bent, this total reflection transitions into partial reflection at the respective points, which likewise has the effect of a characteristic reduction of the light-conducting behaviour, which can be detected by the connected evaluation unit.

The invention claimed is:

1. An escalator or moving walkway comprising a comb plate disposed at each of an entry and an exit of the escalator or the moving walkway, wherein the comb plate mounts comb segments having teeth that mesh with grooves in escalator steps or moving-walkway panels, wherein a safety installation at the comb segments has a predetermined thickness and extends transversely to a running direction of the escalator or the moving walkway, wherein the safety installation is mounted at a transition between the comb plate and the comb segments and movements of the comb plate and/or of the comb segments are detectable via the safety installation.

2. The escalator or moving walkway of claim 1, wherein the safety installation is elastically mounted at the transition between the comb plate and the comb segments.

3. The escalator or moving walkway of claim 1, wherein the safety installation bears on the comb segments and from the comb plate is elastically pressed against said comb segments, wherein the safety installation is received or embedded in an elastic compound or is supported by an elastic element and is pressed against the comb segments by the elastic compound or the elastic element.

4. The escalator or moving walkway of claim 1, wherein an oblique face that forms a bearing for the safety installation is configured between the comb plate and the comb segments, wherein the oblique face at an end that is spaced apart from free ends of the teeth transitions into a vertical face that extends from the oblique face up to the surface of the comb segments and of the comb plate, wherein the comb segments and the comb plate at their surfaces are disposed so as to be flush with one another.

5. The escalator or moving walkway of claim 1, wherein in the comb plate a clearance that receives an elastic compound or an elastic element that mounts the safety installation is configured within a bearing face that points towards the comb segments.

6. The escalator or moving walkway of claim 1, wherein in the comb segments a clearance that receives an elastic compound or an elastic element that mounts the safety installation is configured within a bearing face which points towards the comb plate.

7. The escalator or moving walkway of claim 1, wherein the safety installation is received in a groove in an elastic compound or an elastic element, wherein the elastic compound or the elastic element holds the safety installation in the groove in an elastic and pre-tensioned manner.

8. The escalator or moving walkway of claim 1, wherein the safety installation is connected to an evaluation unit that detects and identifies signals that are transmitted by the safety installation and distinguishes periodic signals from non-periodic signals.

9. The escalator or moving walkway of claim 1, wherein an evaluation unit filters out short-time changes of an output signal that are below a predetermined threshold.

10. The escalator or moving walkway of claim 1, wherein signals that are detected by the safety installation and evaluated by an evaluation unit are transmittable to a centre informed about safety-relevant failures and normal loading of the comb plate and/or of the comb segments.

11. An escalator or moving walkway comprising:

a comb plate disposed at each of an entry and an exit of the escalator or the moving walkway, wherein the comb plate mounts comb segments that include teeth that mesh with grooves in escalator steps or moving-walkway panels;

a safety device at the comb segments having a thickness and extending transversely to a running direction of the escalator or the moving walkway, wherein a clearance is formed in the comb plate and/or in the comb segments that receives the safety device, wherein movements of at least one of the comb plate or the comb segments are detectable via the safety device; and an elastic compound or an elastic element disposed in the clearance for mounting the safety device.

12. The escalator or moving walkway of claim 11 wherein the safety device is disposed on the comb segments.

13. An escalator or moving walkway comprising:

a comb plate disposed at each of an entry and an exit of the escalator or the moving walkway, wherein the comb plate mounts comb segments having teeth that mesh with grooves in escalator steps or moving-walkway panels; and a safety installation at the comb segments having a predetermined thickness and extending transversely to a running direction of the escalator or the moving walkway, wherein the safety installation is mounted at a transition between the comb plate and the comb segments and movements of at least one of the comb plate or the comb segments are detectable via the safety installation, the safety installation being configured as at least one of:

a capacitive proximity sensor, wherein at least one ribbon conductor or round conductor serves as the first electrode and the comb segments or the comb plate serves/serve as a counter electrode, and the movement of at least one comb segment from a rest position is detectable therewith, wherein the at least one ribbon conductor or round conductor of the safety installation is composed of a conductive elastomer, an inductive proximity sensor, a resistance sensor, an optical sensor, wherein an elastic tube extends transversely across an entire width of the comb plate or the comb segments, respectively, or a flow sensor, wherein an elastic tube extends transversely across an entire width of the comb plate or of the comb segments and said elastic tube is passed through by a suitable medium, wherein a change in flow which is caused by deformation of the elastic tube that is induced by the movement of at least one comb segment from the rest position is detectable.

14. The escalator or moving walkway of claim 13, wherein the safety installation is configured as the optical sensor, wherein a light source is situated at one end of the elastic tube and the optical sensor is situated at an opposite end of the elastic tube, wherein a change in luminance caused by deformation of the elastic tube that is induced by the movement of at least one comb segment from the rest position is detectable by the optical sensor.

15. The escalator or moving walkway of claim 13, wherein the safety installation is configured as the capacitive proximity sensor, wherein the at least one ribbon conductor or round conductor is guided in the clearance or in a groove of the elastic compound, wherein preferably the clearance acts as a guard electrode for the at least one ribbon conductor or round conductor.

16. The escalator or moving walkway of claim 15, wherein the safety installation is configured as the optical sensor, wherein a light source and the optical sensor are disposed at one end of the elastic tube and a reflector is disposed an opposite end of the elastic tube.

17. The escalator or moving walkway of claim 15, wherein the safety installation is configured as the resistance sensor, wherein the resistance sensor is formed by a resistance rubber that extends across an entire width of the comb plate and/or the comb segments.

18. The escalator or moving walkway of claim 15, wherein the safety installation is configured as the resistance sensor, wherein the resistance sensor is formed by individual strain gauges that in each case extend across joints between each comb segment and in this manner the movement of at least one comb segment from the rest position in relation to a comb segment that is directly adjacent to that comb segment is detectable with each strain gauge, wherein the individual strain gauges are in particular connected in series.

19. The escalator or moving walkway of claim 15, wherein the safety installation is configured as the resistance sensor, wherein the resistance sensor is formed by a band of strain gauges that extends across an entire width of the comb plate and/or the comb segments.

20. The escalator or moving walkway of claim 19, wherein the band of strain gauges is tensioned between protrusions on the comb plate or the comb segments, respectively, in a manner of a zigzag pattern, wherein the individual movements of the comb segments add up.

* * * * *